US006623627B1

(12) United States Patent
Zhou

(10) Patent No.: US 6,623,627 B1
(45) Date of Patent: Sep. 23, 2003

(54) PRODUCTION OF LOW SULFUR GASOLINE

(75) Inventor: Lubo Zhou, Fox River Grove, IL (US)

(73) Assignee: UOP LLC, Des Plaines, IL (US)

( * ) Notice: Subject to any disclaimer, the term of this patent is extended or adjusted under 35 U.S.C. 154(b) by 142 days.

(21) Appl. No.: 09/901,215

(22) Filed: Jul. 9, 2001

(51) Int. Cl.[7] ..... C10G 45/00; C10G 45/04; C10G 45/24; C10G 45/60

(52) U.S. Cl. ..... 208/208 R; 208/209; 208/211; 208/212; 208/213; 208/218; 208/226; 208/227; 208/228; 208/230

(58) Field of Search ..... 208/208 R, 209, 208/211, 212, 213, 218, 226, 227, 228, 230

(56) References Cited

U.S. PATENT DOCUMENTS

| | | | | | |
|---|---|---|---|---|---|
| 2,634,230 | A | | 4/1953 | Arnold et al. | 196/24 |
| 3,957,625 | A | | 5/1976 | Orkin | 208/211 |
| 4,831,206 | A | * | 5/1989 | Zarchy | 585/737 |
| 4,973,396 | A | * | 11/1990 | Markley | 208/89 |
| 4,990,242 | A | * | 2/1991 | Louie et al. | 208/218 |
| 5,292,428 | A | * | 3/1994 | Harrison et al. | 208/208 R |
| 5,318,690 | A | * | 6/1994 | Fletcher et al. | 208/89 |
| 5,582,714 | A | | 12/1996 | Forte | 208/237 |
| 5,837,130 | A | * | 11/1998 | Crossland | 208/213 |
| 6,024,865 | A | * | 2/2000 | Alexander et al. | 208/218 |
| 6,228,254 | B1 | | 5/2001 | Jossens et al. | 208/212 |
| 6,358,402 | B1 | * | 3/2002 | Schucker | 208/237 |

OTHER PUBLICATIONS

Maple, R.E.; Wizig, H.W. "Removal of Sulfur from Light FCC Gasoline Stream", Presented at NPRA 2000 Annual Meeting, Mar. 26–28 2000, San Antonio Texas.

Gentry, J.C.; Lee, F–M "Novel Process for FCC Gasoline Desulfurization and Benzene Reduction to Meet Clean Fuels Requirements", Presented at NPRA 2000 Annual Meeting, Mar. 26–28, 2000, San Antonio, Texas.

* cited by examiner

*Primary Examiner*—Walter D. Griffin
*Assistant Examiner*—Tam M. Nguyen
(74) *Attorney, Agent, or Firm*—John G. Tolomei; James C. Paschall; John G. Cutts, Jr.

(57) ABSTRACT

A process for desulfurizing a gasoline stream while continuing to maintain the octane rating of the blend stock. A gasoline stream containing sulfur compounds and olefins is introduced into a fractionation zone to produce a low boiling fraction containing mercaptan sulfur compounds and olefins, a mid boiling fraction containing thiophene and olefins, and a high boiling fraction containing sulfur compounds. The low boiling fraction containing mercaptan sulfur compounds is contacted with an aqueous alkaline solution to selectively remove mercaptan sulfur compounds. The mid boiling fraction containing thiophene is extracted to produce a raffinate stream containing olefins and having a reduced sulfur content relative to the mid boiling fraction and a hydrocarbonaceous stream rich in thiophene. The resulting hydrocarbonaceous stream rich in thiophene and the higher boiling fraction containing sulfur compounds is reacted in a hydrodesulfurization reaction zone to produce a hydrocarbonaceous stream having a reduced sulfur concentration.

33 Claims, 1 Drawing Sheet

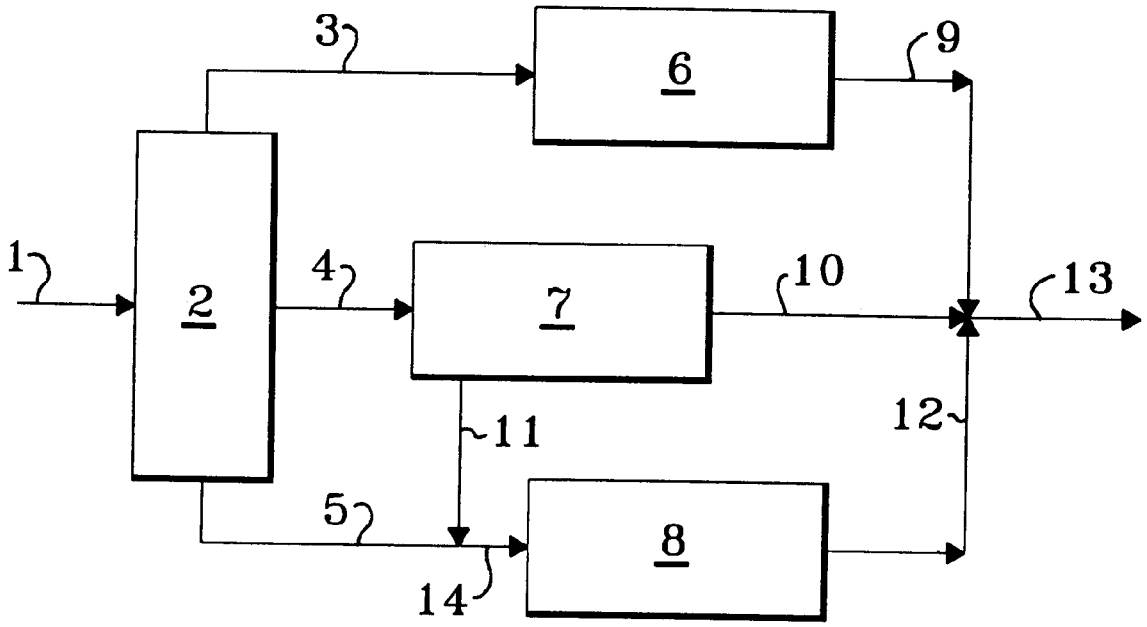
3
6
9
1
2
4
7
10
13
11
12
5
8
14

PRODUCTION OF LOW SULFUR GASOLINE

BACKGROUND OF THE INVENTION

The present invention is directed to a process for reducing the sulfur content in gasoline to a very low level. Gasoline is generally prepared from a number of hydrocarbonaceous blend streams and typical examples include butanes, light straight run naphtha, isomerate, FCC cracked gasoline, hydrocracked naphtha, coker gasoline, alkylate, reformate, ethers and alcohols. Of these, gasoline blend stocks produced in a fluid catalytic cracking unit (FCC), the reformer and the alkylation unit account for a major portion of the gasoline pool. FCC gasoline, and if present, coker naphtha and pyrolysis gasoline, generally contribute a substantial portion of the gasoline pool sulfur.

Sulfur present in the gasoline pool may be in one of several molecular forms, including thiophenes, mercaptans, sulfides and disulfides. Typical thiophenes include thiophene and its alkylated derivatives and benzothiophene and its alkylated derivatives. Typical mercaptans occurring in the sulfur-containing gasoline streams include thiophenol and the alkyl thiols from ethane thiol to nonanethiol, with potentially smaller amounts of the higher alkyl thiols.

A number of methods have been proposed for removing sulfur from gasoline. In general, hydrotreating is the method of choice, because of the cost and ease of processing using the catalytic hydrotreating method. However, sulfur removal by hydrotreating is generally accompanied by substantial octane loss when the olefins in gasoline are converted to low octane components while the sulfur compounds are simultaneously being removed. A number of proposals have been made to offset the octane loss associated with gasoline hydrotreating.

As evidenced from the hereinabove, it is clear that many approaches have been utilized in order to reduce the sulfur level in gasoline. However, new government regulations which require ultra low sulfur levels in gasoline have been promulgated and will be coming into effect soon. Even though very low sulfur levels are desired, there continues to be a need for gasoline which has a high octane rating. With these often-conflicting objectives, it is apparent that there is a need for new methods for reducing sulfur levels in a gasoline pool while maintaining the pool octane rating.

INFORMATION DISCLOSURE

According to U.S. Pat. No. 3,957,625 B1, the sulfur impurities tend to concentrate in the heavy fraction of the gasoline and a method for removing the sulfur includes hydrodesulfurization of the heavy fraction of the catalytically cracked gasoline so as to retain the octane contribution from the olefins which are found mainly in the lighter fraction.

U.S. Pat. No. 6,228,254 B1 (Jossens et al) discloses a two-step sulfur removal process comprising a mild hydrotreating step followed by an extraction step to reduce the sulfur content in gasoline to a very low level without significantly reducing the octane of the gasoline.

U.S. Pat. No. 5,582,714 B1 (Forte) discloses a process for the removal of sulfur from FCC gasoline by employing a solvent. Preferred solvents are glycols and glycol ethers.

U.S. Pat. No. 2,634,230 B1 (Arnold et al) discloses a process for the desulfurization of high sulfur olefinic naphtha wherein 2,4-dimethyl sulfolane is employed to extract sulfur from a highly olefinic naphtha, such that the solvent does not effect separation between olefins and paraffins, to produce a sulfur lean raffinate phase and a sulfur rich extract.

A paper titled, "Removal of Sulfur From Light FCC Gasoline Stream" Presented at the NPRA 2000 Annual Meeting Mar. 26–28, 2000 in San Antonio, Tex. discloses that sulfur compounds in the initial boiling range of light FCC gasoline are primarily mercaptans which are caustic extractable.

A paper titled, "Novel Process For FCC Gasoline Desulfurization and Benzene Reduction to Meet Clean Fuels Requirements" Presented at the NPRA 2000 Annual Meeting, Mar. 26–28, 2000 in San Antonio, Tex. discloses that sulfur and aromatic species in FCC naphtha may be segregated by using solvent extraction.

None of the cited references disclose a three-way splitter with the extraction of thiophene from the mid boiling fraction.

BRIEF SUMMARY OF THE INVENTION

The present invention is a process for desulfurizing a gasoline stream while continuing to maintain the octane rating of the blend stock. In accordance with the process of the present invention, a gasoline stream containing sulfur compounds and olefins is introduced into a fractionation zone to produce a low boiling fraction containing mercaptan sulfur compounds and olefins, a mid boiling fraction containing thiophene and olefins, and a high boiling fraction containing sulfur compounds. The low boiling fraction containing mercaptan sulfur compounds is, in one embodiment, contacted with an aqueous alkaline solution to selectively remove at least a portion of the mercaptan sulfur compounds. The mid boiling fraction containing thiophene and olefins is contacted with a lean solvent to produce a raffinate stream containing olefins and having a reduced sulfur content relative to the mid boiling fraction and a rich solvent stream enriched in the thiophene. The rich solvent stream enriched in thiophene is separated to produce a hydrocarbonaceous stream rich in thiophene. In another embodiment, the thiophene is removed from the mid boiling fraction containing thiophene and olefins by extractive distillation to produce a raffinate stream containing olefins having a reduced sulfur content relative to the mid boiling fraction and a hydrocarbonaceous stream rich in thiophene. The resulting hydrocarbonaceous stream rich in thiophene and the higher boiling fraction containing sulfur compounds is reacted in a hydrodesulfurization reaction zone to produce a hydrocarbonaceous stream having a reduced sulfur concentration.

In accordance with one embodiment, the present invention relates to a process for desulfurizing gasoline containing olefins comprising the steps of: (a) introducing a gasoline stream comprising sulfur compounds and olefins into a fractionation zone to produce a low boiling fraction comprising mercaptan sulfur compounds and olefins, a mid boiling fraction comprising thiophene and a high boiling fraction comprising sulfur compounds; (b) contacting the low boiling fraction comprising mercaptan sulfur compounds with an aqueous alkaline solution to selectively remove at least a portion of the mercaptan sulfur compounds; (c) removing at least a portion of the thiophene in the mid boiling fraction to produce a raffinate stream having a reduced sulfur content relative to the mid boiling fraction and an extract stream enriched in thiophene; (d) separating the extract stream enriched in thiophene to produce a hydrocarbonaceous stream rich in thiophene; (e) reacting the hydrocarbonaceous stream rich in thiophene recovered in step (d) and the high boiling fraction comprising sulfur compounds recovered in step (a) in a hydrodesulfurization reaction zone to produce a hydrocarbonaceous stream having a reduced sulfur concentration; and (f) recovering a desulfurized gasoline comprising olefins.

In accordance with another embodiment, the present invention is a process for desulfurizing gasoline containing olefins comprising the steps of: (a) introducing a gasoline stream comprising sulfur compounds and olefins into a fractionation zone to produce a low boiling fraction comprising mercaptan sulfur compounds and olefins, a mid boiling fraction comprising thiophene and a high boiling fraction comprising sulfur compounds; (b) contacting the low boiling fraction comprising mercaptan sulfur compounds with an aqueous alkaline solution to selectively remove at least a portion of the mercaptan sulfur compounds; (c) contacting the mid boiling fraction comprising thiophene with a lean solvent to produce a raffinate stream having a reduced sulfur content relative to the mid boiling fraction and a rich-solvent stream enriched in the thiophene; (d) separating the rich-solvent stream enriched in thiophene to produce a hydrocarbonaceous stream rich in thiophene; (e) reacting the hydrocarbonaceous stream rich in thiophene recovered in step (d) and the high boiling fraction comprising sulfur compounds recovered in step (a) in a hydrodesulfurization reaction zone to produce a hydrocarbonaceous stream having a reduced sulfur concentration; and (f) recovering a desulfurized gasoline comprising olefins.

And in another embodiment the present invention is a process or desulfurizing gasoline containing olefins comprising the steps of: (a) introducing a gasoline stream comprising sulfur compounds and olefins into a fractionation zone to produce a low boiling fraction comprising mercaptan sulfur compounds and olefins, a mid boiling fraction comprising thiophene and a high boiling fraction comprising sulfur compounds; (b) contacting the low boiling fraction comprising mercaptan sulfur compounds with an aqueous alkaline solution to selectively remove at least a portion of the mercaptan sulfur compounds; (c) introducing the mid boiling fraction comprising thiophene into an extractive distillation zone to produce a raffinate stream having a reduced sulfur content relative to the mid boiling fraction and a hydrocarbonaceous stream rich in thiophene; (d) reacting the hydrocarbonaceous stream rich in thiophene recovered in step (c) and the high boiling fraction comprising sulfur compounds recovered in step (a) in a hydrodesulfurization zone to produce a hydrocarbonaceous stream having a reduced sulfur concentration; and (e) recovering a desulfurized gasoline comprising olefins.

Other embodiments of the present invention encompass further details such as types and descriptions of feedstocks, catalysts, solvents and preferred operating conditions including temperatures and pressures, all of which are hereinafter disclosed in the following discussion of each of the facets of the present invention.

BRIEF DESCRIPTION OF THE DRAWING

The drawing is a simplified process flow diagram of a preferred embodiment of the present invention. The drawing is intended to be schematically illustrative of the present invention and not be a limitation thereof.

DETAILED DESCRIPTION OF THE INVENTION

It has been discovered that when a gasoline stream containing sulfur compounds and olefins is introduced into a fractionation zone to produce a mid boiling fraction containing essentially all of the thiophene while simultaneously producing a low boiling fraction containing mercaptan sulfur compounds and olefins with essentially no thiophene compounds, a resulting ultra low-sulfur gasoline is consistently and economically produced. When the gasoline stream containing sulfur compounds and olefins is produced in an FCC or otherwise, there is often times a fluctuation in the characteristics of the gasoline stream resulting from, for example, different crude sources, activity of any sulfur pretreater upstream of the FCC, FCC operating conditions or operational upsets, and different blends of feedstock to the fractionation zone. The production of the mid boiling fraction helps to ensure that essentially no thiophene is recovered with the low boiling fraction while maximizing the recovery of high octane olefin compounds. Since the low boiling fraction containing olefins and mercaptan sulfur compounds is contacted with an aqueous alkaline solution to remove about 95% of the mercaptan sulfur compounds, a low boiling stream containing mercaptan sulfur compounds in an amount less than about 25 wpm, for example, is produced thereby enabling an overall production of ultra low sulfur gasoline. This approach overcomes the problem of not instantly being able to adjust the fractionation conditions to avoid contaminating the low boiling fraction with thiophene in the event of a feed upset while maximizing the overall recovery of the feed olefins. This is important because the thiophene is not successfully removed by contacting with an aqueous alkaline solution. Therefore, the process of the present invention aids in ensuring that thiophene is prevented from being carried overhead with the low boiling fraction containing the maximum concentration of olefin compounds.

Sulfur compounds present in gasoline occur principally as mercaptans, aromatic heterocyclic compounds, sulfides and disulfides. Relative amounts of each depend on a number of factors, many of which are refinery, process and feed specific. In general, heavier fractions contain a larger amount of sulfur compounds, and a larger fraction of these sulfur compounds are in the form of aromatic heterocyclic compounds. In addition, certain streams commonly blended for gasoline, e.g., FCC feedstocks, contain high amounts of the heterocyclic compounds. Gasoline streams containing significant amounts of these heterocyclic compounds are difficult to process. Very severe operating conditions have been conventionally specified for hydrotreating processes to desulfurize gasoline streams, resulting in a large octane penalty.

The process of the present invention is effective for reducing the sulfur content of a gasoline stream or gasoline. As used herein, a gasoline stream includes individual refinery streams suitable for use as a blend stock for gasoline, or a blended gasoline stream containing two or more streams, each of which are suitable for use as a gasoline blend stock. A suitable gasoline blend stock, when blended with other refinery streams, produces a combined stream which meets the requirements for gasoline, which requirements are well documented in government regulations.

Feed to the process preferably comprises a sulfur-containing petroleum fraction which boils in the gasoline boiling range, including FCC gasoline, coker pentane/hexane, coker naphtha, straight run gasoline, and mixtures containing two or more of these streams. Such gasoline blending streams typically have a normal boiling point within the range of about 32° F. and about 420° F. Feeds of this type include light naphthas typically having a boiling range from about $C_6$ to about 330° F.; full range naphthas, typically having a boiling range from about $C_5$ to about 420°

F.; heavier naphtha fractions boiling in the range from about 260° F. to about 425° F. In general, a gasoline motor fuel will distill over the range from about room temperature to about 425° F.

Aromatic heterocyclic compounds include alkyl-substituted thiophene, thiophenol, alkylthiophene and benzothiophene. Among the aromatic heterocyclic compounds of particular interest in this application are thiophene, 2-methylthiophene, 3-methylthiophene, 2-ethylthiophene, benzothiophene and dimethylbenzothiophene. Mercaptans which will be removed by the process of this invention often contain from 2–10 carbon atoms, and are illustrated by materials such as 1-ethanethiol, 2-propanethiol, 2-butanethiol, 2-methyl-2-propanethiol, pentanethiol, hexanethiol, heptanethiol, octanethiol, nonanethiol and thiophenol.

Sulfur in gasoline originating from these gasoline streams may be in one of several molecular forms, including thiophene, mercaptan, sulfides and disulfides. For a given gasoline stream, the sulfur compounds tend to be concentrated in the higher boiling portions of the stream. In general, gasoline streams suited for treating in the present process contain greater than about 10 ppm thiophenic compounds. Typically, streams containing more than 40 ppm thiophenic compounds, up to 2000 ppm thiophenic compounds and higher may be treated. After treatment, according to the present invention, the sulfur content is desirably less than about 150 ppm, preferably less than 100 ppm and most preferably less than 50 ppm.

The total sulfur content of the gasoline stream to be desulfurized in the present invention will generally exceed 50 ppm by weight and typically range from about 150 ppm to as much as several thousand ppm sulfur. For fractions containing at least 5 volume percent over about 380° F., the sulfur content may exceed about 1000 ppm by weight and may be as high as 4000 to 5000 ppm by weight or even higher. Many gasoline blend streams also contain olefins. Blend streams originating from the FCC, for example, will be olefinic, with an olefin content of at least 5 or more percent, typically in the range of 10 to 30 percent.

In accordance with the present invention, a sulfur-containing gasoline stream is introduced into a fractionation zone such as a naphtha three-way splitter, for example, which is preferably operated at a pressure from about 5 to about 200 psig to produce a low boiling fraction containing mercaptan sulfur compounds and olefins. In order to achieve the goal of overall deep desulfurization, the low boiling fraction preferably contains no appreciable concentration of thiophene, preferably less than about 50 wppm and more preferably less than about 10 wppm. The low boiling fraction preferably boils in the range from about 100 to about 180° F. and preferably has an end boiling point below about 160° F. and more preferably below about 150° F. The resulting low boiling fraction is contacted with an aqueous alkaline solution to selectively remove at least a portion of the mercaptan sulfur compounds. The extraction of mercaptan sulfur compounds with an aqueous alkaline solution depends on the fact that mercaptans are slightly acidic in nature and in the presence of a strong base tend to form salts-called mercaptides-which have a remarkably high preferential solubility in a basic solution. The extraction step is coupled with a regeneration step and an alkaline stream is continuously recirculated therebetween. In the extraction step, the alkaline stream is used to extract mercaptans from the hydrocarbon stream and the resulting mercaptide rich alkaline stream is treated in the regeneration step to remove mercaptide compounds therefrom with continuous cycling of the alkaline stream between the extraction step and the regeneration step. The oxidative regeneration step is typically operated to produce disulfide compounds which are immiscible in the alkaline stream, and the major portion of which disulfide compounds are typically separated therefrom in a settling step. It is preferred that the circulating lean alkaline stream contains a low level of disulfide compounds preferably less than about 50 wppm sulfur in order to achieve the desulfurization targets.

The alkaline solution utilized in the present invention may comprise any alkaline reagent known to have the capability to extract mercaptans from the low boiling hydrocarbon fraction. A preferred alkaline solution generally comprises an aqueous solution of an alkali metal hydroxide, such as sodium hydroxide, potassium hydroxide and lithium hydroxide. A particularly preferred alkaline solution for use in the present invention is an aqueous solution of about 1 to about 50% by weight of sodium hydroxide with particularly good results obtained with aqueous solutions having about 4 to about 25 weight percent sodium hydroxide.

The catalyst, which is used in the oxidation step, is preferably a metal phthalocyanine catalyst. Particularly preferred metal phthalocyanines comprise cobalt phthalocyanine and iron phthalocyanine. Other metal phthalocyanines include vanadium phthalocyanine, copper phthalocyanine, nickel phthalocyanine, molybdenum phthalocyanine, chromium phthalocyanine, tungsten phthalocyanine, magnesium phthalocyanine, platinum phthalocyanine, hafnium phthalocyanine, palladium phthalocyanine, etc. The metal phthalocyanine in general is not highly polar and, therefore, for improved operation is preferably utilized as a polar derivative thereof. Particularly preferred polar derivatives are the sulfonated derivatives such as the monosulfo derivative, the disulfo derivative, the tri-sulfo derivative, and the tetra-sulfo derivative.

The preferred phthalocyanine catalyst can be used in the present invention in one of two modes. First, it can be utilized in a water-soluble form or a form which is capable of forming a stable emulsion in water as disclosed in U.S. Pat. No. 2,853,432 B1. Second, the phthalocyanine catalyst can be utilized as a combination of a phthalocyanine compound with a suitable carrier material as disclosed in U.S. Pat. No. 2,988,500 B1. In the first mode, the catalyst is present as a dissolved or suspended solid in the alkaline stream, which is charged to the regeneration step. In this mode, the preferred catalyst is cobalt or vanadium phthalocyanine disulfonate, which is typically utilized in an amount of about 5 to about 1,000 wt. ppm of the alkaline stream. In the second mode of operation, the catalyst is preferably utilized as a fixed bed of particles of a composite of the phthalocyanine compound with a suitable carrier material. The carrier material should be insoluble or substantially unaffected by the alkaline stream or hydrocarbon stream under the conditions prevailing in the various steps of the process. Activated charcoals are particularly preferred because of their high adsorptivity under these conditions. The amount of the phthalocyanine compound combined with the carrier material is preferably about 0.1 to about 2.0 wt. percent of the final composite. Additional details as to alternative carrier materials, methods of preparation, and the preferred amount of catalytic components for the preferred phthalocyanine catalyst for use in this second mode are given in the teachings of U.S. Pat. No. 3,108,081 B1.

A mid boiling fraction containing thiophene and olefins is produced and removed from the fractionation zone and preferably boils in the range from about 100° F. to about 300° F. and preferably has an end boiling point below about 250° F. The resulting mid boiling fraction is, in one embodiment, contacted with a solvent which is selective to remove thiophene from the mid boiling fraction. The liquid-liquid extraction zone may operate at a capacity and efficiency necessary to remove essentially all of the thiophene. The selective solvents employed in the instant invention, in general, are water-miscible organic liquids at the operating temperature of the process. Furthermore, the selective solvents must have a boiling point and a decomposition temperature higher than the operating temperature of the process, wherein the operating temperature of the process refers to the liquid—liquid extraction temperatures at which the feedstock is contacted with the solvent and the solvent regeneration temperature. The term "water-miscible" describes those solvents which are completely miscible with water over a wide range of temperatures, which have a high partial miscibility with water at room temperature, and which are completely miscible with water at operating temperatures. By the term "essentially all of the sulfur compounds," it is meant that the sulfur content of the treated stream is preferably less than about 100 wppm and more preferably less than about 50 wppm.

Selective solvents employed in the present invention may be low molecular weight, preferably having a molecular weight less than about 400 and more preferably less than about 200. Examples of such solvents include polyalkylene glycols and polyalkylene glycol ether. In general, any suitable solvent which demonstrates the desired characteristics herein described may be utilized in the present invention. Such selective solvents may include, for example, sulfolane, furfural, n-formyl morpholine, n-methyl 2-pyrrolidone, dimethyl sulfoxide, pentaethylene glycol, dimethyl formamide, tetra-ethylene glycol and methoxyl-tri-glycol.

The extraction of thiophene can be made to operate at high recovery by circulating more and more solvent. The resulting rich solvent containing the thiophene is distilled to recover a hydrocarbonaceous stream containing the thiophene and to prepare a lean solvent which is returned to the liquid—liquid extraction zone.

In another embodiment of the present invention, the mid boiling fraction containing thiophene and olefins may be separated by extractive distillation to produce a raffinate stream containing olefins and having a reduced thiophene content and thereby a reduced sulfur content relative to the mid boiling fraction, and an extract stream enriched in thiophene. The extractive distillation may be conducted while using any of the hereinabove-mentioned solvents which are selective for thiophene. Since extractive distillation is well known to those skilled in the art, no further description is deemed warranted.

The fractionation zone also produces a high boiling fraction containing sulfur compounds and preferably boils in the range from about 150° F. to about 425° F. The resulting high boiling fraction comprising sulfur compounds and the hydrocarbonaceous stream containing the thiophene derived from the thiophene extraction are introduced into a hydrodesulfurization reaction zone with hydrogen and contacted with one or more beds of the same or different catalysts. In addition to the desulfurization of the hydrocarbonacoeus compounds, it is contemplated that other reactions may also be performed in one or more sequential catalyst beds including hydrocracking, hydroisomerization, de-alkylation and alkylation, for example. The primary goal of the hydrodesulfurization reaction zone is to remove sulfur from the heterogeneous compounds to thereby produce hydrogen sulfide but in addition, an equally important function is the improvement of the octane rating of the hydrocarbon stream exiting the hydrodesulfurization reaction zone. The octane improvement may be the result of any of the hereinabove-described reactions.

One type of preferred catalyst useful in the process of the present invention is a conventional hydrotreating catalyst of the type used to carry out hydrodesulfurization reactions and contain a metal from Group VI and a metal from Group VIII incorporated with an inorganic oxide such as alumina, for example. The commercial catalysts of this type generally fall into one or more of the numerous nickel-molybdenum or cobalt-molybdenum or nickel-tungsten or cobalt-tungsten families. The catalytic metals are preferably supported by alumina or other low acidic inorganic oxide support material. Such catalysts do not have cracking activity because they are non-zeolitic, non-acidic catalysts which function to promote hydrodesulfurization reactions. Such catalysts are well known in the art and the amounts of the hydrogenation components in these catalysts may range from about 0.5% to about 10% by weight of Group VIII metal components and from about 5% to about 25% by weight of Group VI metal components, calculated as metals per 100 parts by weight of total catalyst. The hydrogenation components in the catalyst may be in the oxide or sulfide form. If a combination of at least a Group VI and a Group VIII metal component is present as oxides, it will preferably be subjected to presulfiding prior to use. Suitably the hydrodesulfurization catalyst comprises one or more components of nickel and/or cobalt and one or more components of molybdenum and/or tungsten.

Another type of preferred catalyst useful in the process of the present invention is a catalyst having hydrodesulfurization capability as well as the ability for hydroisomerization. Commercial catalysts of this type generally contain a zeolitic component. Any catalyst which performs as a combination hydrodesulfurization catalyst and hydroisomerization catalyst is suitable for use in the process of the present invention. A particularly preferred catalyst of this type comprises a matrix, at least one support medium substantially uniformly distributed through the matrix and comprising a silica alumina molecular sieve material having a composition $xSiO_2:Al_2O_3:yP_2O_5$ wherein x is at least about 0.1; a first catalytically active metal phase supported on the support medium, the first catalytically active metal phase comprising a first metal and a second metal each selected from Group VIII of the Periodic Table of the Elements, the first metal being different from the second metal; a second catalytically active metal phase supported on the matrix, the second catalytically active metal phase comprising a third metal and a fourth metal each selected from Group VIII and a fifth metal selected from Group VIB, the third metal being different from the fourth metal. The matrix is preferably selected from the group consisting of alumina, silica alumina, titanium alumina and mixtures thereof. Hydroisomerization conditions will vary depending upon the exact catalyst and feedstock to be used and the final product which is desired. Another type of preferred catalyst which may be used in the present invention is a catalyst which performs selective hydrodesulfurization without complete olefin saturation.

Hydrodesulfurization operating conditions preferably include a reaction temperature from about 300° F. to about 650° F., a reaction pressure from about 50 to about 600 psig and a liquid hourly space velocity from about 0.5 to about 12 $hr^{-1}$.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

A naphtha stream from a fluid catalytic cracker containing sulfur and olefins is introduced via line 1 into fractionation zone 2. A low boiling fraction containing mercaptan sulfur compounds and olefins is removed via line 3 and introduced into mercaptan extraction zone 6. A resulting low boiling fraction containing olefins and a reduced concentration of mercaptan sulfur compounds is removed from mercaptan extraction zone 6 via lines 9 and 13. A mid boiling fraction containing thiophene compounds and olefins is removed from fractionation zone 2 via line 4 and introduced into thiophene extraction zone 7. A raffinate stream containing a mid boiling fraction including olefins and having a reduced concentration of thiophene compounds is removed from thiophene extraction zone 7 via lines 10 and 13 and recovered. A mid boiling hydrocarbonaceous stream containing an enhanced concentration of thiophene is removed from thiophene extraction zone 7 via lines 11 and 14 and introduced into hydrodesulfurization reaction zone 8. A high boiling fraction containing sulfur compounds is removed from fractionation zone 2 via lines 5 and 14 and is introduced into hydrodesulfurization reaction zone 8. A high boiling fraction having a reduced concentration of sulfur compounds is removed from hydrodesulfurization reaction zone 8 via lines 12 and 13 and recovered.

The process of the present invention is further demonstrated by the following illustrative embodiment. This illustrative embodiment is, however, not presented to unduly limit the process of this invention, but to illustrate the advantage of the hereinabove-described embodiment. All of the following data were not obtained by the actual performance of the present invention but are considered prospective and reasonably illustrative of the expected performance of the invention.

ILLUSTRATIVE EMBODIMENT

A full boiling range naphtha produced in a fluid catalytic cracker (FCC) in an amount of 43,000 barrels per day (BPD) having an octane rating of 86.6 and containing 28 weight percent olefins and 5000 weight parts per million (wppm) sulfur is introduced into a naphtha splitter to produce a low boiling fraction in an amount of 8392 BPD having an octane rating of 91.1 and containing 57 weight percent olefins and 1537 wppm sulfur, a mid boiling fraction or heart cut in an amount of 12,825 BPD having an octane rating of 83.8 and containing 48 weight percent olefins and 2091 wppm sulfur and a high boiling fraction in an amount of 21,783 BPD having an octane rating of 86.3 and containing 10 weight percent olefins and 7400 wppm sulfur.

The low boiling fraction produced in the naphtha splitter having a thiophene concentration of less than about 40 wppm is extracted with an aqueous sodium hydroxide stream to remove mercaptan sulfur compounds and to produce a resulting hydrocarbon stream in an amount of about 8392 BPD having an octane rating of 91.2 and containing 57 weight percent olefins and only 43 wppm sulfur.

The mid boiling fraction or heart cut is extracted with sulfolane to produce a raffinate stream in an amount of 11,822 BPD having an octane rating of 83.2 and containing 48 weight percent olefins and only 77 wppm sulfur, and the sulfolane extract stream rich in thiophene is distilled to produce a resulting hydrocarbon stream in an amount of 1003 BPD having an octane rating of 91.2 and containing 47 weight percent olefins and 23,051 wppm sulfur.

The high boiling fraction produced in the naphtha splitter and the 1003 BPD hydrocarbon stream containing 23,051 wppm sulfur are introduced into a hydrodesulfurization reaction zone to remove sulfur from the sulfur bearing hydrocarbonaceous compounds and produce hydrogen sulfide, and to subsequently produce a resulting hydrocarbonaceous stream in an amount of 22,393 BPD having an octane rating of 83.9 and containing 0.6 weight percent olefins and only 10 wppm sulfur.

The resulting three hydrocarbonaceous streams having reduced concentrations of sulfur are blended to produce a final hydrocarbonaceous product stream in an amount of 42608 BPD having an octane rating of 85.1 and containing 23 weight percent olefins and only 33 wppm sulfur.

An analysis of the fresh feed and the finished final product is presented in Table 1.

TABLE 1

Analysis of Fresh Feed and Final Product

| | Fresh Feed | Final Product |
|---|---|---|
| Flow, BPD | 43,000 | 42,608 |
| Octane Rating | 86.6 | 85.1 |
| Olefin Content, weight percent | 28 | 23 |
| Sulfur, wppm | 5000 | 33 |

From Table 1, it is noted that the volume yield of the product is 99.1% of the feed. Although the olefin content of fresh feed was reduced from 28 to 23 weight percent, the octane rating only dropped from 86.6 to 85.1. The primary objective of sulfur removal was achieved by a reduction from 5000 to 33 wppm sulfur or 99.3%.

The foregoing description, drawing and illustrative embodiment clearly illustrate the advantages encompassed by the process of the present invention and the benefits to be afforded with the use thereof.

What is claimed is:

1. A process for desulfurizing gasoline containing olefins comprising the steps of:

(a) introducing a gasoline stream comprising sulfur compounds and olefins into a fractionation zone to produce a low boiling fraction comprising mercaptan sulfur compounds and olefins, a mid boiling fraction comprising thiophene and olefins, and a high boiling fraction comprising sulfur compounds and olefins;

(b) contacting the low boiling fraction comprising mercaptan sulfur compounds and olefins with an aqueous alkaline solution to selectively remove at least a portion of the mercaptan sulfur compounds to produce a low boiling fraction having a reduced concentration of mercaptan sulfur compounds and comprising olefins;

(c) removing at least a portion of the thiophene in the mid boiling fraction comprising thiophene and olefins to produce a raffinate stream having a reduced sulfur content relative to the mid boiling fraction and containing olefins, and an extract stream enriched in thiophene; and (d) reacting the extract stream enriched in thiophene produced in step (c) and the high boiling fraction comprising sulfur compounds and olefins recovered in step (a) in a hydrodesulfurization reaction zone to produce a hydrocarbonaceous stream having a reduced sulfur concentration.

2. The process of claim 1, wherein the gasoline comprising sulfur compounds and olefins boils in the range from about 32° F. to about 420° F.

3. The process of claim 1 wherein the fractionation zone is operated at a pressure from about 5 psig to about 200 psig.

4. The process of claim 1 wherein the low boiling fraction comprising mercaptan sulfur compounds and olefins boils in the range from about 100° F. to about 180° F.

5. The process of claim 1 wherein the mercaptan sulfur compounds are selected from the group consisting of 1-ethanethiol, 2-propanethiol, 2-butanethiol, 2-methyl-2-propanethiol, pentanethiol, hexanethiol, heptanethiol, octanethiol, nonanethiol and thiophenol.

6. The process of claim 1 wherein the aqueous alkaline solution contains a catalyst.

7. The process of claim 6 wherein the catalyst is a metal phthalocyanine or a derivative thereof.

8. The process of claim 1 wherein the aqueous alkaline solution comprises an aqueous solution of an alkali metal hydroxide.

9. The process of claim 1 wherein the hydrodesulfurization reaction zone is operated at a pressure from about 50 psig to about 600 psig and a temperature from about 300° F. to about 650° F.

10. A process for desulfurizing gasoline containing olefins comprising the steps of:

(a) introducing a gasoline stream comprising sulfur compounds and olefins into a fractionation zone to produce a low boiling fraction comprising mercaptan sulfur compounds and olefins, a mid boiling fraction comprising thiophene and olefins and a high boiling fraction comprising sulfur compounds and olefins;

(b) contacting the low boiling fraction comprising mercaptan sulfur compounds and olefins with an aqueous alkaline solution to selectively remove at least a portion of the mercaptan sulfur compounds to produce a low boiling fraction having a reduced concentration of mercaptan sulfur compounds and comprising olefins;

(c) contacting the mid boiling fraction comprising thiophene and olefins with a lean solvent to produce a raffinate stream having a reduced sulfur content relative to the mid boiling fraction and containing olefins and a rich-solvent stream enriched in thiophene;

(d) separating the rich-solvent stream enriched in thiophene to produce a hydrocarbonaceous stream rich in thiophene and a lean solvent; and (e) reacting the hydrocarbonaceous stream rich in thiophene recovered in step (d) and the high boiling fraction comprising sulfur compounds and olefins recovered in step (a) in a hydrodesulfurization reaction zone to produce a hydrocarbonaceous stream having a reduced sulfur concentration.

11. The process of claim 10 wherein the gasoline comprising sulfur compounds and olefins boils in the range from about 32° F. to about 420° F.

12. The process of claim 10 wherein the fractionation zone is operated at a pressure from about 5 psig to about 200 psig.

13. The process of claim 10 wherein the low boiling fraction containing mercaptan sulfur compounds and olefins boils in the range from about 100° F. to about 180° F.

14. The process of claim 10 wherein the mercaptan sulfur compounds are selected from the group consisting of 1-ethanethiol, 2-propanethiol, 2-butanethiol, 2-methyl-2-propanethiol, pentanethiol, hexanethiol, heptanethiol, octanethiol, nonanethiol and thiophenol.

15. The process of claim 10 wherein the aqueous alkaline solution contains a catalyst.

16. The process of claim 15 wherein the catalyst is a metal phthalocyanine or a derivative thereof.

17. The process of claim 10 wherein the aqueous alkaline solution comprises an aqueous solution of an alkali metal hydroxide.

18. The process of claim 10 wherein the lean solvent is selected from the group consisting of sulfolane, furfural, n-formyl morpholine, n-methyl 2-pyrrolidone, dimethyl sulfoxide, pentaethyl glycol, dimethyl formamide, tetraethylene glycol and methoxyl-tri-glycol.

19. The process of claim 10 wherein the lean solvent is sulfolane.

20. The process of claim 10 wherein the lean solvent is dimethyl sulfoxide.

21. The process of claim 10 wherein the hydrodesulfurization reaction zone is operated at pressure from about 50 psig to about 600 psig and a temperature from about 300° F. to about 650° F.

22. A process for desulfurizing gasoline containing olefins comprising the steps of:

(a) introducing a gasoline stream comprising sulfur compounds and olefins into a fractionation zone to produce a low boiling fraction comprising mercaptan sulfur compounds and olefins, a mid boiling fraction comprising thiophene and olefins, and a high boiling fraction comprising sulfur compounds and olefins;

(b) contacting the low boiling fraction comprising mercaptan sulfur compounds and olefins with an aqueous alkaline solution to selectively remove at least a portion of the mercaptan sulfur compounds to produce a low boiling fraction having a reduced concentration of mercaptan sulfur compounds and comprising olefins;

(c) introducing the mid boiling fraction comprising thiophene and olefins into an extractive distillation zone to produce a raffinate stream having a reduced sulfur content relative to the mid boiling fraction and containing olefins, and a hydrocarbonaceous stream rich in thiophene; and (d) reacting the hydrocarbonaceous stream rich in thiophene recovered in step (c) and the high boiling fraction comprising sulfur compounds and olefins recovered in step (a) in a hydrodesulfurization zone to produce a hydrocarbonaceous stream having a reduced sulfur concentration.

23. The process of claim 22 wherein the gasoline comprising sulfur compounds and olefins boils in the range from about 32° F. to about 420° F.

24. The process of claim 22 wherein the fractionation zone is operated at a pressure from about 5 psig to about 200 psig.

25. The process of claim 22 wherein the low boiling fraction containing mercaptan sulfur compounds and olefins boils in the range from about 100° F. to about 180° F.

26. The process of claim 22 wherein the mercaptan sulfur compounds are selected from the group consisting of 1-ethanethiol, 2-propanethiol, 2-butanethiol, 2-methyl-2-propanethiol, pentanethiol, hexanethiol, heptanethiol, octanethiol, nonanethiol and thiophenol.

27. The process of claim 22 wherein the aqueous alkaline solution contains a catalyst.

28. The process of claim 27 wherein the catalyst is a metal phthalocyanine or a derivative thereof.

29. The process of claim 22 wherein the aqueous alkaline solution comprises an aqueous solution of an alkali metal hydroxide.

30. The process of claim 22 wherein the extractive distillation zone utilizes a solvent selected from the group consisting of sulfolane, furfural, n-formyl morpholine, n-methyl 2-pyrrolidone, dimethyl sulfoxide, pentaethyl glycol, dimethyl formamide, tetra-ethylene glycol and methoxyl-tri-glycol.

31. The process of claim 30 wherein the solvent is sulfolane.

32. The process of claim 30 wherein the solvent is dimethyl sulfoxide.

33. The process of claim 22 wherein the hydrodesulfurization reaction zone is operated at pressure from about 50 psig to about 600 psig and a temperature from about 300° F. to about 650° F.

* * * * *